United States Patent [19]

Wotton

[11] 4,217,961

[45] Aug. 19, 1980

[54] WATER SPRINKLERS

[75] Inventor: John Wotton, Weybridge, England

[73] Assignee: Angus Fire Armour Limited, London, England

[21] Appl. No.: 891,141

[22] Filed: Mar. 28, 1978

[30] Foreign Application Priority Data

Apr. 2, 1977 [GB] United Kingdom ..... 14003/77

[51] Int. Cl.[2] ..... A62C 37/14

[52] U.S. Cl. ..... 169/41

[58] Field of Search ..... 169/37–41

[56] References Cited

U.S. PATENT DOCUMENTS

| | | | |
|---|---|---|---|
| 417,396 | 12/1889 | Roper | 169/41 |
| 3,253,657 | 5/1966 | Job | 169/38 |
| 4,099,573 | 7/1978 | Sahara | 169/37 |

FOREIGN PATENT DOCUMENTS

| | | | |
|---|---|---|---|
| 2146372 | 3/1972 | Fed. Rep. of Germany | 169/37 |
| 2225215 | 12/1972 | Fed. Rep. of Germany | 169/38 |
| 2206993 | 8/1973 | Fed. Rep. of Germany | 169/41 |
| 2242847 | 3/1975 | France | 169/37 |
| 6413417 | 11/1965 | Netherlands | 169/41 |
| 12722 | of 1884 | United Kingdom | 169/41 |
| 1322179 | 7/1973 | United Kingdom | 169/38 |
| 1350991 | 4/1974 | United Kingdom | 169/41 |

*Primary Examiner*—Charles A. Marmor

*Attorney, Agent, or Firm*—Stevens, Davis, Miller & Mosher

[57] ABSTRACT

A fire extinguishing sprinkler comprises a support body for supporting a temperature sensitive element provided normally to retain a closure member in position to prevent the flow of fluid through a fluid passage extending through the support body but to permit displacement of the closure member in the event of a fire. The closure member has a sealing surface which extends substantially parallel relative to the direction of fluid flow through the passage to continue to effect a seal during small relative movement between the fluid passage and temperature sensitive element under normal operating conditions.

17 Claims, 5 Drawing Figures

WATER SPRINKLERS

Figure 1:
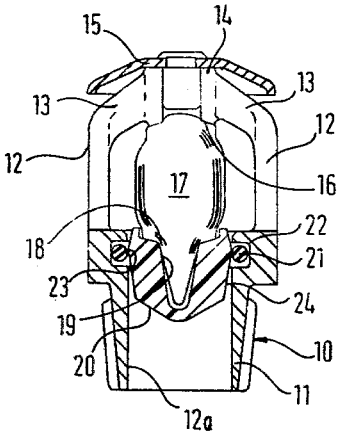

This invention relates to sprinklers and in particular, though not exclusively, to fire extinguishing water sprinklers provided with a temperature sensitive element which serves as an actuating device for automatic operation in the event of a fire.

Water sprinklers as used for automatic operation in the event of fire commonly comprise a metal support body rigidly affixed to a water or other extinguishant supply system, and have an actuating device linked to a closure member such as a soft copper washer which is displaced when the temperature rises above a predetermined level thereby to allow water or other extinguishant fluid to emerge and be distributed over the required area. The temperature sensitive actuating device conventionally comprises either a temperature sensitive fusible linkage having articulations joined by a solder which melts at a predetermined temperature, or a glass bulb which is destroyed by increase in pressure of fluid contained therein in consequence of a rise in temperature. The water or other extinguishant fluid flowing through the sprinkler is deflected or re-directed by impingement on a shroud which provides the desired spray pattern and break-up of the water droplets.

Usually the fusible linkage or glass bulb destructable element is arranged to extend between the metal support body and closure member, and normally be under residual compression loading so as to maintain the closure member in sealing contact against an annular shoulder provided in the sprinkler body around an extinguishant fluid passage.

However, this form of construction possesses disadvantages which include the need to provide for adjustment during assembly of the sprinkler so as to compensate for dimensional variations in manufacture and thus ensure that the linkage or bulb may normally bear against the closure member with a specified degree of pre-loading and continue to ensure a fluid-tight seal even at the maximum extinguishant pressure experienced in the system to which the sprinkler is connected. Adjustment can readily be effected by providing the support body with an adjustment screw having at one end a location disc for bearing against the glass bulb or linkage, but this adds to the manufacturing cost of the components.

Another difficulty arises in the selection of a suitable material for the closure member such that when loaded it is sufficiently rigid to withstand the necessary pre-loading while also being adequately resilient in combination with the temperature sensitive element to accommodate small changes in dimensions caused by pressure and temperature effects on the metal body of the sprinkler and still maintain an adequate seal.

Many different materials and combinations of materials have been considered for forming the closure member but none have been found which are totally satisfactory for providing the required degree of flexibility to accommodate the effects of temperature and pressure changes while simultaneously ensuring an adequate fluid-tight seal when the extinguishant fluid in the system is at a maximum pressure.

Furthermore especially in the case of glass bulb sprinklers the compressive loading on the glass bulb necessary to maintain an adequate degree of pre-loading of the closure member is sufficiently high to incur serious risk of compressive failure of the glass bulb resulting in premature activation of the sprinkler. The chances of such premature activation with consequent damage to the property which the sprinkler is designed to protect in the case of fire are greatly increased if the sprinkler is mounted in a situation where it is subjected to mechanical vibration or to accidental impact even of a minor nature. Greater uniformity in the strength of the glass bulbs would assist in reducing this risk but for practical manufacturing purposes improved uniformity would represent a difficult and expensive requirement.

It is an object of the present invention to provide an improved sprinkler in which the afore-described difficulties are mitigated or overcome.

In accordance with one aspect of the present invention a sprinkler comprises a support body for supporting a temperature sensitive element in engagement with a closure member positioned normally to prevent the flow of extinguishant fluid through a fluid passage extending through the support body, the closure member being provided with a sealing surface which extends in the direction of flow of fluid through the passage and continues to effect a fluid-tight seal in the fluid passage during relative movement between the fluid passage and temperature sensitive element under normal operating conditions.

In one construction the closure member may be permanently fixed in sealing contact with the sprinkler body and said sealing surface may bear against the temperature sensitive element.

Preferably, however, the sealing surface bears directly or indirectly against the sprinkler body to effect a seal therebetween. When the temperature sensitive element releases its support from the closure member the latter may be dislodged from the fluid flow passage by fluid pressure and thus not restrict the flow of fluid.

The sealing surface may extend parallel with the axial direction of fluid flow through the passage, or at a slight angle thereto (e.g. in the range 0° to 15°) for reasons which will be described in more detail below. Higher angles may, however, be used, the requirement being that the sealing surface is substantially parallel to said direction of fluid flow and not at right angles thereto.

In accordance with another aspect of the present invention there is provided a closure member for effecting a fluid-tight seal between the body and temperature sensitive element of a sprinkler head, the closure member being of a substantially tubular shape having a radially outer surface which at least in part is of a frustoconical shape which tapers inwards in a direction away from an end of the member provided with a recess for location of the temperature sensitive element.

Figure 2:
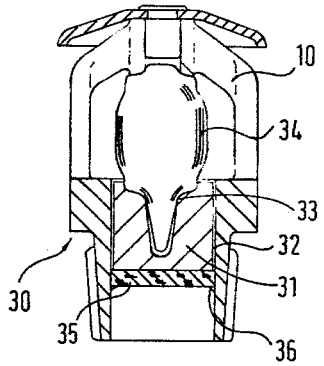
Figure 2A:
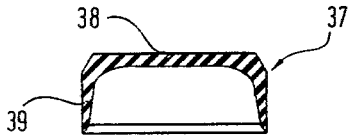

Several embodiments of the invention will now be described, by way of example, with reference to the accompanying drawings in which:

FIGS. 1 to 4 respectively show partially in cross-section four sprinklers in accordance with different aspects of the present invention, and FIG. 2*a* shows an alternative closure member for use in the sprinkler shown in FIG. 2.

Referring to FIG. 1, in a first embodiment of the invention a fire extinguishant sprinkler comprises a brass support body 10 having an externally screw-threaded base portion 11 for attachment to the pipe work of an extinguisher system. A smooth bore cylindrical passage 12*a* for the flow of extinguishant fluid extends centrally through the base portion. Two support arms 12 extend from the base portion 11 in a direction generally axial and parallel with the direction of fluid flow through the base portion. The ends 13 of the arms furthest from the base portion are inclined inwards to a boss 14 into which a spray shroud 15 is press fitted.

The boss 14 is shaped to provide a seating surface 16 for one end of a temperature sensitive glass bulb 17, the glass bulb being of the conventional kind containing a suitable liquid, such as paraffin, and formed of thin glass such that when subjected to temperatures greater than a predetermined level expansion of the paraffin shatters the bulb. The other end of the bulb is formed with a shoulder and neck portion 18 which seats in a complementarily shaped central recess 19 of a displaceable closure member 20 which will now be described in more detail.

The closure member 20 is in the form of a substantially cylindrical plug for rotation in the fluid passage 12 and has a maximum diameter slightly greater than the internal diameter of an O-ring 21 of silicone or nitrile rubber located in a groove 22 formed in the wall of the passage. The radially outer surface of the plug 20 has a portion 23 of maximum diameter slightly spaced from that axial end of the plug formed with the recess 19, and tapers inwardly from the position of maximum diameter towards each end of the plug at an included angle of 15° (i.e. $7\frac{1}{2}$° taper).

In the assembly of the sprinkler the dimensions of the plug and other components are selected such that the O-ring seal 21 normally bears on that tapered surface 24 extending in a direction away from the end of the plug formed with the recess.

In use of the sprinkler under normal operating conditions the O-ring seal 21 bears against the plug 20 to effect a seal and prevent escape of pressurized fluid from within the fluid passage 12 and associated pipe work. Since the plug surface 24 against which sealing is effected has only a small angle of taper, axial movement of the plug relative to the O-ring seal as a result of temperature and pressure changes causes in sufficient change in the contact pressure between the plug and seal to adversely affect the quality of the sealing performance. The primary purpose of the taper on the plug sealing surface is to facilitate ease of displacement of the plug under the extinguishant fluid pressure, in the event of fire, but the direction of taper also serves to discourage migration of the plug back into the passage such as might occur as a result of temperature variations if the associated system were unpressurized and the plug not continuously urged to bear against the glass bulb.

For ease of assembly of the sprinkler it is preferred that the glass bulb and closure member are introduced into position through the fluid passage 12*a* and for this purpose a taper is provided on that part of the plug between its point of maximum diameter and that end formed with the recess 19.

To facilitate smooth movement of the plug relative to the O-ring seal the plug is made of Fluon or other low friction material, such as Teflon, having the characteristic of being stick-slip free and a coefficient of friction less than 0.3. Such material, in an alternative construction, may be provided merely as a coating on a rubber or metal core of the plug at least at that surface which constitutes the sealing surface. A further advantage of using the low friction material in this manner is that in addition to providing smooth relative movement between the glass bulb and fluid passage during normal operation, in the event that the glass bulb shatters the plug will be expelled quickly from the fluid passage and present only the minimum interference to the flow of extinguishant fluid. The provision of a low friction material is not, however, essential and metals such as brass, or non-porous ceramic materials, may be used at the sealing surface.

FIG. 2 illustrates a second embodiment of the invention in which a sprinkler 30 is provided with a body and bulb constructed substantially similar to that described in respect of the preceding embodiment of the invention with the exception that the O-ring and groove are omitted and the plug 31 is of a modified design.

The plug 31 is of a substantially cylindrical shape of uniform cross-sectional size and shape, and formed of ceramic material. One end of the plug is formed with a recess 32 similar to that provided in respect of the preceding embodiment of the invention, to accommodate the neck and shoulder portions 33 of the glass bulb 34. In the sprinkler assembly the non-recessed end of the plug is covered by a cushion element 35 formed from a thin layer of frangible material such as cork, the cushion element bearing outwards in sealing contact with the cylindrical wall of the fluid passage and being held in contact against the end of the plug 31 by an annular band 36 of adhesive such as Loctite.

In this embodiment of the invention under normal operating conditions the cushion element 35 remains fixed in position relative to the fluid passage and temperature and pressure effects on the sprinkler body arms and other parts of the sprinkler are accommodated by relative sliding movement between the plug and sprinkler body.

In operation of the sprinkler when the glass bulb is shattered by increase of internal pressure due to temperature rise, the plug offers no support to the thin cushion seal 35 which in consequence breaks to leave the passage clear for the flow of extinguishant fluid.

In a modified construction, illustrated in FIG. 2*a*, the cork cushion element 35 may be replaced by a closure cap 37 of nylon or silicone rubber having an end face 38 for bearing against the plug closure member 31, and a thin skirt 39 the outer cylindrical surface of which is urged into sealing contact against the wall of the fluid passage under the action of the extinguishant fluid pressure. In the event of fire causing the glass bulb 34 to cease to support the plug 31, the fluid pressure dislodges both the plug 31 and cap 37. In a further modification the cushion element may be formed integral with the closure member as a part thereof.

Figure 3:
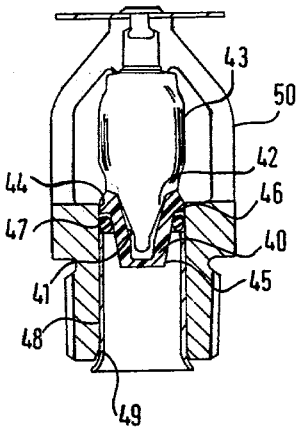

In a third embodiment of the invention, illustrated in FIG. 3, a sprinkler comprises a body and bulb substantially as described in respect of the second embodiment of the invention, but with a modified plug closure member. In this embodiment the plug 40 is shaped at one end to provide a recess 41 in which the neck and shoulder portion 42 of the glass bulb 43 is located. For a short distance from the recessed end of the plug the radially outer plug surface 44 is substantially cylindrical, and has a diameter slightly smaller than that of the bore of the fluid passage. The remaining portion 45 of the outer surface of the plug is of a substantially frusto-conical shape having an included angle of 20°, with that part of the surface of larger diameter lying towards the recessed end and radially inwards of the cylindrical part 44 so as to define an annular radially extending shoulder 46. In the assembly of the plug and sprinkler body an O-ring seal 47 is located between the bore of the fluid passage 48 and the frusto-conical surface 45 to effect a fluid-tight seal therebetween. A metal retaining sleeve 49 is provided in the fluid passage to prevent any possible movement of the O-ring seal in a direction away from the glass bulb 43 so that temperature and pressure effects on the sprinkler body, particularly the arms 50 thereof, result primarily only in relative movement between the O-ring and plug. In a manner similar to that described in respect of the first embodiment of the invention by virtue of the low taper angle of the frusto-conical surface said relative movement causes little variation in the pressure with which the plug bears against the O-ring seal and thus the quality of the sealing effect between the O-ring and plug is substantially independent of normal temperature and pressure effects. Furthermore the glass bulb does not require to continually be subjected to a high compression loading as in the case of a conventional sprinkler.

In normal operation of the sprinkler the taper angle of the frusto-conical surface 45 is sufficient to resist movement of the plug into the fluid passage, for example when extinguishant is being drained from the system and a negative pressue exists temporarily.

During normal operation under static conditions, pressure in the system tends to move the O-ring into the increasingly restricted annulus between the fluid passage and plug thus progressively improving the seal effect. The relative manufacturing dimensions of the cylindrical passage 48 in the body and the tapered plug are so chosen that the '0' is never pressed hard against the plug shoulder.

The retaining sleeve 49 is in contact with the 'O' ring when fixed during assembly, not pressing against it, and plays no part in the sealing effect. Its function is to prevent migration of the O-ring and plug into the passage 48 under negative pressure conditions, for example when extinguishant is being drained from the system.

As described, it will be understood that the O-ring is compressed radially between the circular faces of the fluid passage and the plug, and never by the end wall provided by the plug shoulder and the sleeve.

In the event of fire causing the glass bulb to break, the frusto-conical surface serves to ensure ease of displacement of the plug and thus no undue resistance to the subsequent flow of extinguishant fluid.

The retaining sleeve 49 provided for the O-ring may be in the form of a circular member of plastic or metal dimensioned to be a press fit within the bore, it may be a split sleeve which exerts spring pressure against the bore wall sufficient to resist subsequent axial movement, or it may be in the form of a thin shell secured to the bore wall by an adhesive or, for example, by soldering.

Figure 4:
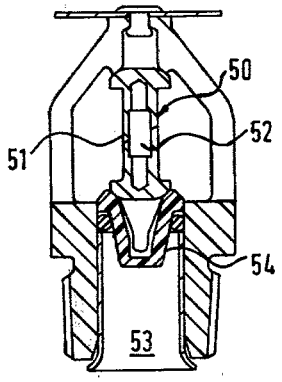

In a fourth embodiment of the invention, illustrated in FIG. 4, a sprinkler is constructed substantially similar to that shown in FIG. 3 except that the temperature sensitive element comprises a fusible strut as described in the specification of co-pending U.S. Application No. 947,524 filed Oct. 2, 1978.

The strut 50 comprises a pair of nylon tubes 51 held in alignment by means of rod 52 of low melting point metal alloy. The facing ends of the tubes are angled relative to the length of the strut such that, in the event of a fire causing the rod to melt, the tubes become displaced sideways under the pressure of extinguishant fluid in the passage 53. The strut then ceases to support the closure member 54 which is displaced to permit flow of extinguishant.

The present invention obviates the need for the temperature sensitive element to carry high forces in order to compress a resilient closure member as in hitherto known sprinklers. The temperature sensitive element requires only to withstand the forces caused by the pressure of extinguishant fluid acting on the closure member and thus the arms and other parts of the sprinkler support body as well as the temperature sensitive element are not required to be as robust. This is a particular advantage where the temperature sensitive element comprises a glass bulb for which careful adjustment of the support body would otherwise be required to ensure that the bulb were not overloaded and its risk of premature fracture increased. It is, however, also an advantage where the temperature sensitive element comprises a fusible strut as shown in FIG. 4 since if the strut is not required to withstand high compressive loadings the fusible rod or element may be made smaller and thus have a more rapid response to temperature changes.

As well as avoiding the need for careful adjustment a sprinkler and closure member in accordance with the present invention will normally dispense with the need to individually pressure test assembled sprinklers.

Having now described my Invention—what I claim is:

1. A sprinkler comprising a support body, a fluid passage extending through said support body, a substantially tubular shaped closure member having a recess at one end and a radially outer frusto-conical sealing surface which has a substantially radially outwardly extending shoulder adjacent to said recessed end and tapers inwardly in a direction away from said recessed end and extends in the direction of flow of fluid through said fluid passage to effect a fluid-tight seal in said fluid passage, a temperature sensitive element seated in said recess and acting between said support body and said closure member, sealing means located in said fluid passage and bearing against said sealing surface, said closure member being shaped so that its maximum diameter is less than the minimum diameter of said fluid passage and positioned to be free to move in an axially inwards and in an axially outwards direction relative to said fluid passage and maintain said fluid-tight seal during relative movement between said temperature sensitive element and said fluid passage under normal operation conditions.

2. A sprinkler according to claim 1 wherein said sealing surface extends at an angle of no more than 15° relative to said direction of fluid flow.

3. A sprinkler according to claim 1 wherein said sealing surface is of a material having a coefficient of friction less than 0.3.

4. A sprinkler according to claim 1 wherein said sealing means has a coefficient of friction less than 0.3.

5. A sprinkler according to claim 1 wherein said sealing means comprises an O-ring.

6. A sprinkler according to claim 1 in which said support body is of unitary construction.

7. A sprinkler according to claim 1 in which the maximum diameter of said temperature sensitive element is less than the minimum diameter of said fluid passage.

8. A sprinkler according to claim 1 including means in the fluid passage to limit the inward movement of the closure member into the fluid passage.

9. A sprinkler comprising a support body, a fluid passage extending through said support body, a substantially tubular shaped closure member having a recess at one end and a portion of maximum diameter intermediate its ends with the radially outer surface of said closure member between said portion of maximum diameter and said recessed end tapering inwards in a direction towards said recessed end, said closure member further having a sealing surface defined its radially outer surface between said portion of maximum diameter and the end opposite said recess being of frusto-conical shape and tapering inwards in a direction away from said portion of maximum diameter, said closure member extending in the direction of flow of fluid through said fluid passage to effect a fluid-tight seal in said fluid passage, a temperature sensitive element seated in said recess and acting between said support body and said closure member, sealing means located in said fluid passage and bearing against said sealing surface, said closure member being shaped and positioned to be free to move in an axially inwards and in an axially outwards direction relative to said fluid passage and maintain said fluid-tight seal during relative movement between said temperature sensitive element and said fluid passage under normal operating conditions.

10. A sprinkler according to claim 9 wherein said sealing means comprises an O-ring.

11. A sprinkler according to claim 10 wherein said O-ring is located in a recess in said fluid passage.

12. A sprinkler according to claim 11 wherein the internal diameter of said O-ring is less than the diameter of said portion of maximum diameter of said closure member.

13. A sprinkler according to claim 9 wherein said sealing surface extends at an angle of no more than 15° relative to said direction of fluid flow.

14. A sprinkler according to claim 9 wherein said sealing surface is of a material having a coefficient of friction less than 0.3.

15. A sprinkler according to claim 9 wherein said sealing means has a coefficient of friction less than 0.3.

16. A sprinkler according to claim 9 in which said support body is of unitary construction.

17. A sprinkler according to claim 9 in which the maximum diameter of said temperature sensitive element is less than the minimum diameter of said fluid passage.

* * * * *